United States Patent [19]

Karsan et al.

[11] Patent Number: 4,938,630

[45] Date of Patent: Jul. 3, 1990

[54] METHOD AND APPARATUS TO STABILIZE AN OFFSHORE PLATFORM

[75] Inventors: Demir I. Karsan; Zeki Demirbilek, both of Houston, Tex.

[73] Assignee: Conoco Inc., Ponca City, Okla.

[21] Appl. No.: 235,136

[22] Filed: Aug. 22, 1988

[51] Int. Cl.[5] ..... B63B 35/44

[52] U.S. Cl. ..... 405/224; 114/264; 405/204; 405/195

[58] Field of Search ..... 405/195, 203, 224, 202; 114/264, 265

[56] References Cited

U.S. PATENT DOCUMENTS

| | | | |
|---|---|---|---|
| 3,285,213 | 11/1966 | Whittle | 114/265 |
| 3,522,709 | 8/1970 | Vilain | 405/202 |
| 3,626,701 | 12/1971 | Laffont | 405/202 |
| 3,720,066 | 3/1973 | Vilain | 405/202 |
| 3,768,268 | 10/1973 | Laffont et al. | 405/202 |
| 3,986,367 | 10/1976 | Kalpins . | |
| 4,112,864 | 9/1978 | Bergman | 114/265 |
| 4,422,806 | 12/1983 | Abbott et al. | 405/195 |
| 4,437,794 | 3/1984 | Grimsley et al. | 405/224 |
| 4,505,620 | 3/1985 | Andrier | 405/224 |
| 4,674,918 | 6/1987 | Kalpins | 405/224 |
| 4,702,648 | 10/1987 | Stageboe et al. | 405/224 |
| 4,784,529 | 11/1988 | Hunter | 405/195 X |

FOREIGN PATENT DOCUMENTS 2200082 7/1988 United Kingdom .

OTHER PUBLICATIONS

SeaTek International, Inc. (The Deep Hybrid Floating Platform), Report #87124, Mar. 14, 1988-pp. 1-7 and Appendix A.

*Primary Examiner*—Randolph A. Reese
*Assistant Examiner*—Arlen L. Olsen
*Attorney, Agent, or Firm*—R. K. Thomas; A. J. Reinert

[57] ABSTRACT

Method and apparatus to stabilize a columnar platform for deepwater offshore applications. An added mass stabilizer system is utilized to control first order heave, pitch, roll, surge and sway motions of the floating platform. The stabilizer is suspended beneath the platform by a set of tendons a sufficient distance to (1) enter a quiescent zone beneath the action of waves and currents, (2) provide a sufficiently long movement arm to resist pitch and roll torquing, and (3) incorporate sufficient flexibility into the suspension system to avoid shock loads. The stabilizer is sized to (a) provide sufficient submerged weight to maintain the tendons in constant tension and, (b) create adequate added mass (actual stabilizer weight plus mass of water moved by the stabilizer) to provide the desired control of first order motions. A secondary mooring system such as a spring-buoy mooring or dynamic positioning system can be provided to control drift produced by higher order motions and first order yaw.

12 Claims, 2 Drawing Sheets

METHOD AND APPARATUS TO STABILIZE AN OFFSHORE PLATFORM

BACKGROUND AND SUMMARY OF THE INVENTION

As the exploration for oil and gas moves further and further offshore, continued innovation is necessary to provide economic solutions to the technical challenges posed by the increased water depths. The method and apparatus of the present invention for stabilizing a floating offshore platform is such a responsive innovation.

The practical depth limit for a fixed bottom-mounted platform is about 1500 feet. Fixed platforms may encounter economic limits, depending on the size of the reservoir, prices of steel and oil, etc., at considerably shallower depths. As a result, the industry is generally moving from fixed platforms to column-stabilized floating platforms such as semi-submersible vessels and tension leg platforms for deep water applications.

A number of significant innovations have been made in conjunction with the creation of a second generation tension leg platform for installation in Green Canyon off the Louisiana coast. These improvements significantly enhance the cost effectiveness of TLPs and include reducing the size and weight of the TLP itself; utilizing a one-piece, thin walled buoyant tendon, described and claimed in commonly assigned U.S. patent application Ser. No. 07/105,941, now U.S. Pat. No. 4,784,529; including a side-entry bottom-installed tendon receptacle to facilitate installation, as described and claimed in commonly assigned U.S. patent application Ser. No. 07/105,942, now U.S. Pat. No. 4,784,529; and providing external mooring porches on the TLP columns, as described and claimed in commonly assigned U.S. patent application Ser. No. 07/105,943, now U.S. Pat. No. 4,784,529.

While these innovations will make TLPs attractive for deeper water usage, they are apt to have practical limits of usage on the order of 4000 feet water depth. Even at depths of 3000 feet, the one-piece buoyant tendon begins to experience limitations. For a conventional steel tendon, the diameter to wall thickness ratio (D/t) for the tendon needs to exceed 29 in order to maintain buoyancy. Yet, the need to increase wall thickness to reinforce the structural integrity of the tendon against possible collapse under hydrostatic pressure at 3000 feet below the ocean's surface, makes it difficult to maintain the necessary D/t ratio.

Without neutral buoyancy, the one-piece tendon design loses some of its attractiveness for comparative ease of transportation and installation. The increased tendon diameters needed for approaching the neutral buoyancy state (2" wall thickness results in 60" diameter) would experience increased drag forces from waves and currents. These fluid drag forces coupled with the tendons' weight produce catenary deflections of the tendons which decrease the angles of departure of the tendons from their connection points to the hull of the TLP. This reduces the effective stiffness of the tension legs, negatively impacting the mooring system's ability to retard surge and sway motions.

The heave flexibility of a tendon is equal to its length divided by the product of its modulus of elasticity and its effective cross-sectional area. As increasing water depth necessitates an increase in the lengths of the tendons, for a particular material, the effective cross-sectional area must increase to prevent an increase in flexibility. However, as already discussed, such an increase in area (or wall thickness) negatively impacts the tendon's weight. Failure to reduce the flexibility, however, results in increased heave, pitch, roll, surge and sway of the platform. Of particular concern is the possibility of increasing a second order motion period into a range subject to harmonic resonance for common wave intervals (typically 3 to 26 seconds). Such a possibility could produce a cataclysmic failure of the tendons and endanger the floating platform and its crew. Hence, resonance must be avoided in spite of the resulting weight penalty and its associated problems.

Reduced buoyancy and increased flexibility each contribute to a need for a larger pretension within the tendons. This, in turn, requires additional reinforcement (i.e., additional weight) at the connection points for the tendons on the TLP columns, to accommodate the additional loading. Further, the costs associated with (a) placing a foundation template to which the tendons attach and (b) the procedure for connecting the tendons themselves, increase appreciably with the depth of the water.

The present invention overcomes the above-mentioned difficulties for all column-stabilized platforms (semi-submersibles and TLP's) by eliminating the need for anchoring the platform to the seafloor in order to control first order motions. An added mass stabilizer is suspended a significant distance (e.g., 500 feet) beneath the column-stabilized floating platform by a plurality of tendons. A stabilizer system can be designed to accommodate a particular floating platform to adequately control first order heave, pitch, roll, surge and sway motions by providing an added mass stabilizer of sufficient submerged weight to maintain the suspending tendons in tension for all load conditions and sufficient added mass (submerged weight plus weight of the volume of water subject to movement when the stabilizer mass moves) to produce the desired behavior, i.e., to "convince" the extrinsic forces that this platform is an anchored platform because it behaves like one. Second and higher order platform motions, which contribute to platform and stabilizer drift, can be resisted by a secondary system such as a spring-buoy mooring arrangement or a dynamic positioning system. When necessary, either the platform or the stabilizer or both could be supplemented with additional mooring.

Various other characteristics, advantages, and features of the present invention will become apparent after reading the following detailed description of the preferred embodiments.

DETAILED DESCRIPTION OF THE PREFERRED EMBODIMENTS

Figure 1:
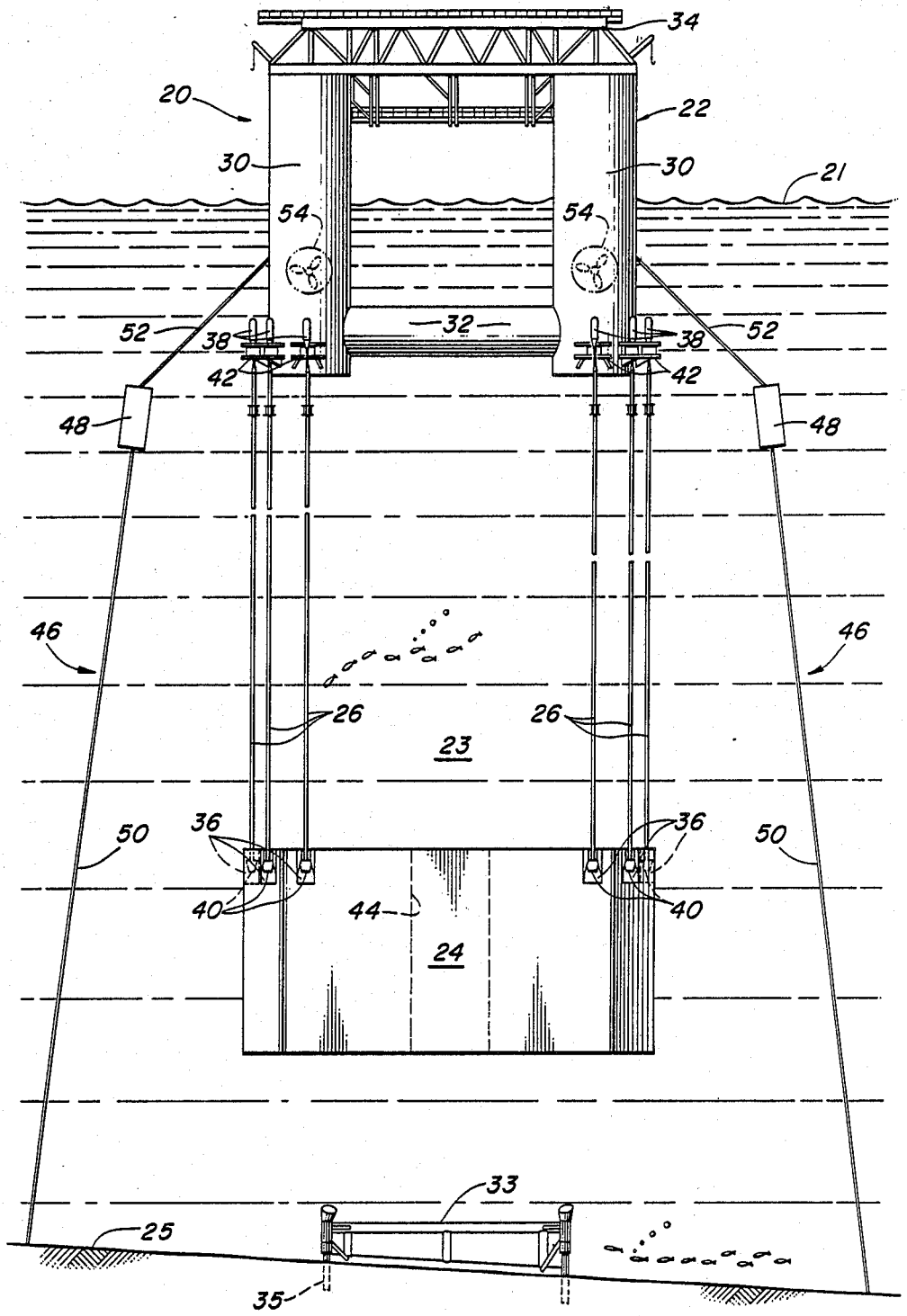
FIG. 1 is a schematic side elevation of the column-stabilized platform with an added mass stabilizer suspended therebeneath.

This deepwater offshore platform of the present invention is shown in FIG. 1 generally at 20. While this platform is designed to afford particular advantage in water depths exceeding 3000 feet, it will be appreciated that it may be utilized to advantage in shallower water depths. For example, where the seafloor is particularly uneven or of a silty consistency making foundation template placement treacherous, platform 20 of the present invention could avoid such difficulties.

Offshore platform 20 has three principal components: floating platform 22, a stabilizer 24, and a plurality of tendons 26 which interconnect stabilizer 24 to platform 22 and suspend it therebeneath. Floating platform 22 is of the column-stabilized variety more typically identified as semi-submersible vessels or tension leg platforms. A minimum of at least one vertical column 30 will be utilized to stabilize platform 22. More generally, a plurality of vertical columns 30 are interconnected by pontoons 32 to form a polygonal structure. Both the columns 30 and the pontoons 32 are partially hollow, sealed compartments to provide sufficient buoyancy to accommodate the weight of all of the principal components enumerated and keep deck 34 and a significant portion of platform 22 above the surface 21 of the water 23.

Figure 2:
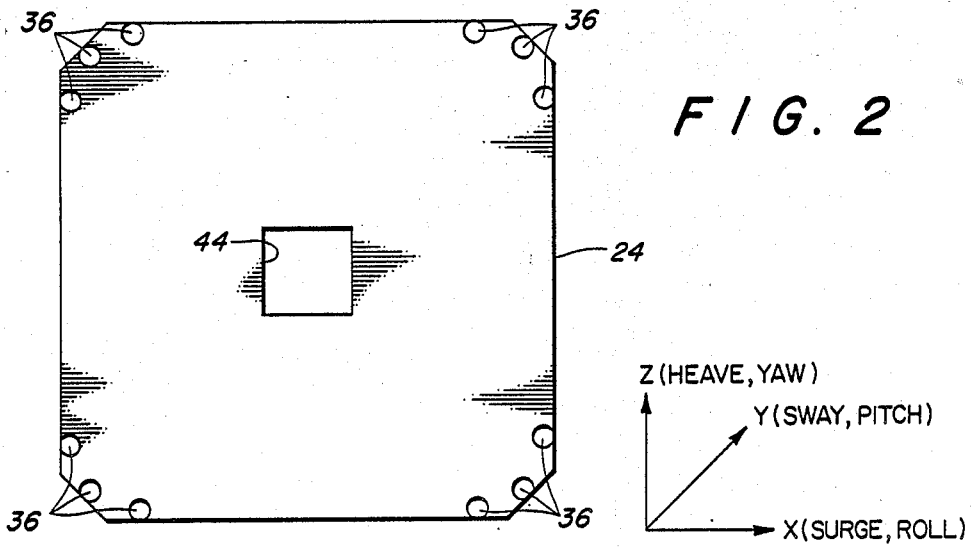
FIG. 2 is a top view of one embodiment of an added mass stabilize in FIG. 1.

As seen in FIG. 2, stabilizer 24 is generally square with cropped corners to accommodate three connecting ports 36 at each corner for tendons 26. Tendons 26 will preferably be of sufficient length to suspend stabilizer 24 in a quiescent zone beneath the action of waves and currents. Other factors impacting the length of the tendons are the material chosen for the tendons and the performance characteristics of the stabilizer system. For a particular material (steel, titanium, or composite fibers, for example), the tendon will need to be of sufficient length to provide a moment arm for the stabilizer mass which will adequately resist the pitch and roll tendencies of the platform induced by waves and currents. Further, the tendons will have to be of sufficient length for that chosen material so that the suspension system has adequate flexibility to avoid shock loads. While the stabilizer 24 has been depicted as being square, it will be appreciated other configurations (circular, oblong, hexagonal, octagonal) are also possible. In addition to the weight in water of stabilizer 24, an additional stabilizing force generated by the mass of a hemisphere of water above mass stabilizer, for heave motions for example, will be provided. This mass of water that must be moved to accommodate movement of stabilizer 24 together with the mass of the stabilizer itself is identified as the added mass stabilizer or simply as the added mass. An opening 44 in stabilizer 24 permits access for drilling and production operations through drilling template 33 mounted on the ocean floor 25 by means of piles 35 (FIG. 1). It will be appreciated that the lateral dimensions of the stabilizer will produce lateral stabilizer masses associated with translational movement of stabilizer 24.

Tendons 26 are preferably of the one-piece neutrally buoyant design described in the aforementioned copending application Ser. No. 07/105,941, now U.S. Pat. No. 4,784,529 incorporated herein by reference. They may be equipped with enlarged top and bottom connectors 38 and 40, respectively, which include a flexible bushing that permits some relative pivotal motion between the bottom receptacle 34 and bottom connector 40 and top connector 38 and top receptacle 42. While the use of adjustable connectors is not as crucial in this particular usage as it was in the bottom anchored tension leg platform of the referenced application, their use is nonetheless preferred to facilitate independent installation and removal of tendons 26. Note, neutral buoyancy of tendons 26 will be more easily provided since these tendons will not be exposed to deep water hydrostatic pressures and, therefore need not be reinforced against possible hydrostatic collapse. On the other hand neutral buoyancy, while preferred, is not essential since the length of these tendons make them more easily barged to the installation site than tendons whose lengths may exceed 1500 feet. Further, the use of materials other than steel, such as fiber composites enhance the prospects of providing neutral buoyancy without sacrificing strength since such composites employing carbon and Kevlar fibers are 5 times as strong as steel (Kevlar is a registered trademark of DuPont de Nemours & Co.).

Figure 3:
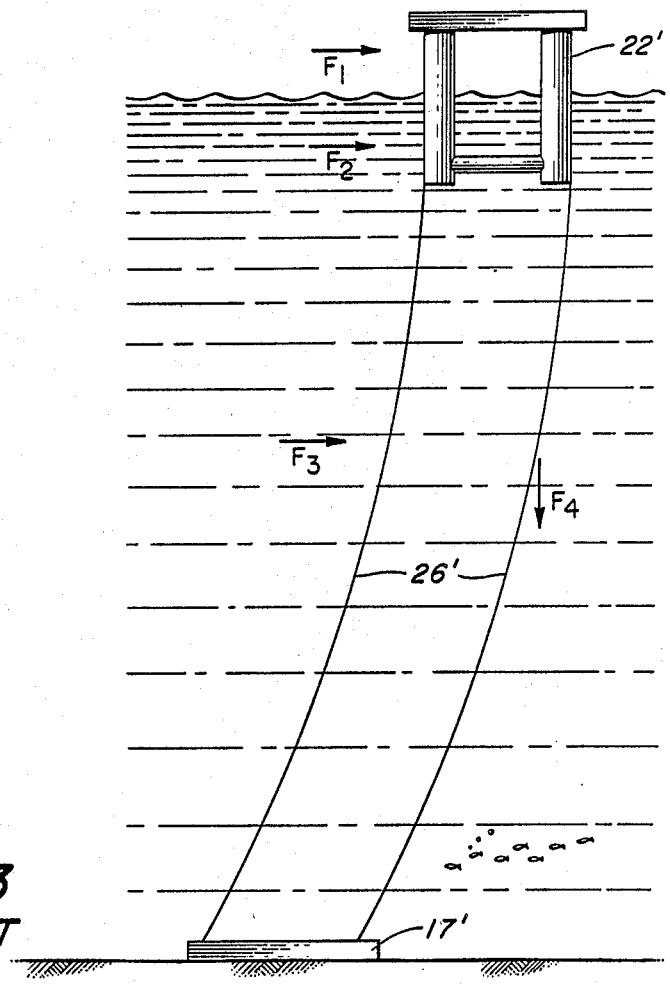
FIG. 3 PRIOR ART
FIG. 3 is a schematic side elevation of a conventional bottom-anchored, column-stabilized platform.

FIG. 3 depicts a conventional tension leg platform 22, anchored to the seafloor in 3000 feet of water by a foundation template 17, The wall thickness of tendons 26, required to withstand the hydrostatic forces make stand alone neutral buoyancy, for steel tendons of this length, impossible. The large diameters needed to approach neutral buoyancy to permit the tendons to be towed to the site using floatation collars increase the drag forces of waves ($F_2$) and currents ($F_3$). These drag forces combine with the weight of the tendons ($F_4$) and the action of the wind ($F_1$) on the platform 22 to increase the catenary deflections. Further, the very length of the tendons themselves add to the flexibility of the tension legs. These elements combine to increase the amount of platform motion (FIG. 1), heave being the vertical motion, surge the to-and-fro motion along the x-axis, sway along the y-axis, pitch the rotation around the y-axis, roll around the x-axis and yaw around the z-axis.

By contrast, the stabilizer 24 of the platform 20 of the present invention, is positioned, depending on the tendon material and the current characteristics of the location, a minimum of 300 feet beneath the ocean's surface. Although there is no limit on how deeply the stabilizer 24 can be placed a practical or economic limit may be reached at about 1000 feet. Accordingly, suspending tendons 26 can be constructed with thinner walls because of the reduced pressures at 1000 vs. 3000 foot water depth. Hence, neutral buoyancy is obtainable with thinner diameter tendons reducing drag forces (as well as weight). Additional savings are realized since a massive foundation template need not be lowered to the ocean floor and secured with piles driven into the ocean floor. All motions of the mass stabilized platform 20 are compliant.

By way of example and not limitation, a floating platform that is 177 feet square, having four 37 foot diameter columns, a total weight of approximately 10,500 short tons, and a draft of 75 feet, can be stabilized in an ocean experiencing a maximum wave height of about 72 feet and a significant wave height of about 41 feet by an added mass stabilizer 24 which is 190 foot square weighing 2025 short tons (which produces an added stabilizer mass of 82,550 short tons for controlling first order heave motion) suspended by 12 tubular tendons 26 each having a length of 700 feet and an effective cross-sectional area of 15 square inches (a total of 180 $in^2$). (Note, for steel tendons a practical minimum depth will be about 500 feet.) The stabilizer preferably has a thickness of between 40 and 100 feet and most preferably is about 90 feet high. Such a massive structure weighing only 2000 tons will necessarily be constructed of tubular steel with a skin of plate steel or similar material. Such a system provides a platform experiencing less than 4 feet first order heave and natural periods of 30.08 seconds for first order heave, 2.07 for second order heave, surge and sway periods of 28.08 seconds (first) and 1.84 seconds (second), and pitch and roll periods of 140.26 seconds (first) and 121.56 seconds (second).

It will be understood that stabilizer 24 (and its added mass) is effective at controlling first order motions only. Second and higher order motions including drift of the platform will need to be controlled by a secondary system. It is preferred that a spring-buoy mooring system 46 be employed to maintain the horizontal position of platform 20 against possible drifting. Such a system would employ at least eight (two from each corner) submerged spring-buoys 48 interconnected to the ocean floor by anchored chains 50 and to the columns 30 of platform 20 by spring-tensioned cables 52. As a second alternative, a plurality of directable propellers 54 could be used in a dynamic positioning system. In such a system, the dynamic forces of wind, current and waves are measured and opposed by directional propellers 54 to maintain it in a fixed position relative to the ocean floor 25. Such positioning systems are widely used in the industry as shown in U.S. Pat. Nos. 3,844,242 and 4,444,143 incorporated in pertinent part by reference.

The present invention describes a method and apparatus of stabilizing a columnar platform 22 such as a semi-submersible vessel or tension leg platform. A stabilizer 24 sized to accommodate the particular platform 22 is suspended beneath said platform by a plurality of tendons 26 at a distance between 300 and 1000 feet below the lowermost portion of the platform. The sizing of the stabilizer includes (a) providing sufficient submerged weight to maintain tendons 26 in constant tension and (b) designing the dimensions of the stabilizer to create an added mass stabilizer (actual weight in water plus weight of volume of water moved with the stabilizer) to control first order heave, pitch roll, surge and sway of the platform, both as to magnitude of the motion and natural frequency of the particular restoring force. The tendons will be sized to provide the necessary strength and flexibility in the suspension system. Although not specifically mentioned, the stabilizer 24 will provide, to a lesser degree, some yaw control for platform 22. However, because of the necessary flexibility of the tendons and of the tendon suspension system (which permits some relative rotational movement between elements 26 and 22, 24) the yaw control will primarily be provided by the secondary mooring system (i.e., the spring-buoy system or dynamic positioning system).

To install the stabilizer 24, buoyancy tanks (not shown) may be attached to allow the stabilizer 24 to reach a subsurface equilibrium point at about 100 feet below the surface 21. The stabilizer 24 may then be towed underneath platform 22, a sling attached and it may be lowered by means of a drill string by partially flooding the buoyancy tanks. The twelve tendons may be sequentially installed using the swingdown method described in application Ser. No. 07/105,941, now U.S. Pat. No. 4,784,529. The secondary mooring system may be engaged at this time or in the case of the spring-buoy system, may have been partially installed before positioning stabilizer 24 and the remaining lines 50 installed after suspension is completed. The buoyancy tanks may be completely flooded and remain a part of the stabilizer mass or they may be detached and retrieved.

Various changes, modifications, and alternatives will become apparent to a person of ordinary skill in the art following a reading of the foregoing specification. It is intended that all such changes, modifications and alternatives as fall within the scope of the appended claims be considered part of the present invention.

We claim:

1. A column-stabilized floating platform for utilization in deep water, offshore hydrocarbon exploration and production, above a selected portion of a seafloor, said platform comprising:

a floating platform having at least one column which is at least partially hollow to provide positive buoyancy, said column supporting at least one above-surface deck;

a stabilizer connected to and suspended a substantial distance beneath said floating platform by a plurality of suspension tendons, said stabilizer having (a) sufficient submerged weight to maintain said suspension tendons in tension and (b) a sufficient added mass, produced by said submerged weight plus resistance to motion of a portion of the water surrounding said stabilizer, to satisfactorily control first order wave-induced heave, pitch, roll, surge and sway motions of said floating platform without the need for anchoring said platform to said seafloor.

2. The column-stabilized platform of claim 1 wherein said floating platform comprises a plurality of at least three columns which are interconnected by pontoons to define a polygonal structure, each of said columns and said pontoons being at least partially hollow to provide positive buoyancy, said pontoons being substantially totally submerged.

3. The column-stabilized platform of claim 1 wherein said tendons are at least 300 feet long.

4. The column-stabilized platform of claim 1 wherein said tendons are constructed of tubular steel.

5. The column-stabilized platform of claim 4 wherein said tubular steel tendons have a diameter to wall thickness ratio exceeding 29.

6. The column-stabilized platform of claim 4 wherein said tubular steel tendons have a length in the range between about 500 feet and 1000 feet.

7. The column-stabilized platform of claim 1 further comprising a plurality of spring-buoy moorings for controlling drift and other second order motions.

8. The column-stabilized platform of claim 1 further comprising a dynamic positioning system to control drift and other second order induced motions.

9. An added mass stabilizer system for use in retaining a column-stabilized buoyant platform above a selected portion of a seafloor, said added mass stabilizer system comprising:

a stabilizer;

means for suspending said mass stabilizer a substantial distance beneath said buoyant platform, said suspending means including a plurality of tendons extending between and connected to each of said buoyant platform and said mass stabilizer; whereby the buoyancy of said platform is sufficient to support its own weight, the weight of said tendons and the weight of said mass stabilizer, and said stabilizer has (a) sufficient submerged weight to maintain each of said plurality of tendons in constant tension, and (b) sufficient added mass produced by resistance to motion of a portion of the water surrounding said stabilizer to satisfactorily control first order wave-induced heave, pitch, roll, surge and sway motions of said floating platform without the need for anchoring said platform to said seafloor.

10. The added mass stabilizer system of claim 9 wherein said suspending tendons have lengths of at least 300 feet.

11. The added mass stabilizer system of claim 9 wherein said suspending tendons are preferably constructed of tubular steel having lengths in the range from 500 feet to 1000 feet.

12. A method of securing a buoyant column-stabilized floating platform in a position above a selected portion of a seafloor, said method comprising:

locating said floating platform in position above said selected position of said seafloor;

positioning a mass stabilizer of sufficient submerged weight to maintain a downward force on said floating platform for all load conditions and of sufficient added mass to effectively control first order wave-induced heave, pitch, roll, surge and sway motions beneath said floating platform;

interconnecting said mass stabilizer to said floating platform such that said stabilizer is suspended beneath said floating platform;

utilizing said added mass to control said first order motions without the need of anchoring said platform to said portion of said seafloor.

* * * * *

UNITED STATES PATENT AND TRADEMARK OFFICE

CERTIFICATE OF CORRECTION

PATENT NO. : 4,938,630

DATED : July 3, 1990

INVENTOR(S) : Demir Karsan and Zeki Demirbilek

It is certified that error appears in the above-identified patent and that said Letters Patent is hereby corrected as shown below:

Front page under Attorney, Agent, or Firm, "R.K. Thomas" should be --R.K. Thomson--.

Column 1, line 33, after "Ser. No. 07/105,942" delete --, now U.S. Pat. No. 4,784,529--.

Column 1, line 36, after "Ser. No. 07/105,943" delete ", now U.S. Pat. No. 4,784,529" and insert --U.S. Pat. No. 4,844,659--.

Column 2, line 58, "stabilize" should be --stabilizer--.

Column 4, line 14, after "22" delete "," and insert --'--.

Column 4, line 16, after "17" delete "," and insert --'.--.

Column 4, line 17, after "26" delete "," and insert --'--.

Signed and Sealed this

Sixteenth Day of July, 1991

*Attest:*

*Attesting Officer*

HARRY F. MANBECK, JR.

*Commissioner of Patents and Trademarks*